US006976576B2

(12) United States Patent
Intini

(10) Patent No.: US 6,976,576 B2
(45) Date of Patent: Dec. 20, 2005

(54) CHILD-RESISTANT DISPENSER

(76) Inventor: Thomas D. Intini, 9270 Recollet Street, Brossard, Quebec (CA) J4X 1B9

( * ) Notice: Subject to any disclaimer, the term of this patent is extended or adjusted under 35 U.S.C. 154(b) by 349 days.

(21) Appl. No.: 10/439,949

(22) Filed: May 16, 2003

(65) Prior Publication Data

US 2005/0011773 A1 Jan. 20, 2005

(51) Int. Cl.[7] ..... B65D 43/20
(52) U.S. Cl. ..... 206/1.5; 206/531; 206/540; 220/345.3; 220/345.4
(58) Field of Search ..... 206/1.5, 531, 532, 206/534, 540; 220/345.3, 345.4

(56) References Cited

U.S. PATENT DOCUMENTS 4,046,255 A * 9/1977 Ackeret ..... 206/387.12
4,120,400 A * 10/1978 Kotyuk ..... 206/528
4,561,400 A * 12/1985 Hattori ..... 123/674
5,275,291 A * 1/1994 Sledge ..... 206/531

* cited by examiner

*Primary Examiner*—David T. Fidei
(74) *Attorney, Agent, or Firm*—Eric Fincham

(57) ABSTRACT

A child-resistant/senior friendly dispensing package comprising a dispensing member having a dispensing cavity and a product storage cavity, the dispensing member being mounted within a sleeve movable from a first stored position to a second position wherein the dispensing cavity is exterior of the housing to permit dispensing of the product, a device having first and second locks which must be operated either sequentially or simultaneously in order to move the dispensing cavity exteriorly of the housing. The device preferably permits the dispensing of only a single tablet or product.

11 Claims, 4 Drawing Sheets

CHILD-RESISTANT DISPENSER

FIELD OF THE INVENTION

The present invention relates to containers and more particularly, relates to child-resistant container packaging.

BACKGROUND OF THE INVENTION

The use of child-resistant packaging is well known in the art and is utilized for many different types of goods. Primarily, this type of packaging is used for those products which represent a potential hazard in the hands of children—i.e. medicants and the like. The approach adopted for the child resistant packaging usually depends upon the product per se—i.e. its size, format, etc. Thus, for example, in the field of medicines many different types of pill containers have locking tops. These locking tops can only be released by performing a manocuver while turning the top. Generally, one may be required to either depress or lift the top while turning in order to disengage various locking mechanisms. Similarly, it is known in the art to package tablets in different types of blister packages which are designed to prevent easy access by children.

In designing child-resistant packages, it is also important that the package can be opened without undue difficulty by the average consumer for whom the product is intended. This is frequently a problem in that one of the primary groups of medicant users are the elderly, and packaging which relies on the user having a certain amount of strength to open the packages is often self-defeating in that the elderly find it difficult or impossible to open such packaging. This has led to the use of the term "senior friendly" packaging.

SUMMARY OF THE INVENTION

It is an object of the present invention to provide a child-resistant/senior friendly packaging suitable for a number of different products wherein a substantial amount of strength is not required to open the packaging.

According to one aspect of the present invention, a device for dispensing a controlled quantity of product comprising a housing, a dispensing member having a dispensing cavity formed therein, the dispensing member being movable from a first position wherein the dispensing cavity is rendered inaccessible and a second position wherein the dispensing cavity is exterior of the housing to permit dispensing a product therefrom, and first and second cooperative locking means on both of the dispensing member and the housing, both of the first and second locking means being operative such that when the dispensing member is in the first position with the dispensing cavity mostly within the housing, the first locking means function to maintain the dispensing member and housing in a locked relationship, the second locking means permitting limited movement between the dispensing member and housing while maintaining a locking relationship such that when the first locking means are moved from a locked to an unlocked position, the second locking means remain locked. The device, as aforementioned, has a housing and a dispensing member which is movable with respect thereto. In the preferred embodiment of the present invention, the housing takes the form of a sleeve with the dispensing member being movable therein. As will be understood by those knowledgeable in the art, many different configurations could be utilized although a conventional arrangement is one wherein the dispensing container and the sleeve have an overall rectangular appearance.

The dispensing member, in the preferred embodiment, has a product storage cavity and a dispensing cavity with a channel extending between the two cavities. Preferably, the channel is sized such that only a single product may pass from the storage cavity to the dispensing cavity with the dispensing cavity also preferably being sized to receive only a single unit of the product being dispensed.

As aforementioned, there are provided first and second cooperative locking means on the dispensing member and the housing. The first and second locking means may be designed to either be operated sequentially or simultaneously in order to provide access to a product in the dispensing cavity of the dispensing member.

A dispensing member, relative to the housing, is in a first position when the dispensing cavity is covered by the housing and no access may be had thereto. In an intermediate position, when the first locking means are operated, the dispensing member is movable to a certain degree such that the dispensing cavity is partially visible and exposed exteriorly of the housing. However, a product cannot be dispensed at this point in time.

In its final open position, the second locking means must be operated and a force exerted on the dispensing member such that the dispensing cavity is fully outside of the housing such that access may be had thereto and permitting the dispensing of the product by inverting the package.

In one arrangement, the first locking means may be operated to prevent limited movement of the dispensing member to the intermediate position. However, the second locking means, until opened by the user, retain the dispensing member in a position wherein one may see a portion of the dispensing cavity, but will not have access thereto. It is only the sequential step of operating the second locking means which will permit full access to the dispensing cavity.

In a preferred embodiment, rather than in a sequential opening of the locking means, a simultaneous operation must be performed. In other words, although the first locking means will permit limited movement, unless there is a force to retain the first locking means in an unlocked position, they will return to the locked position.

Simultaneous with the operation of both the first and second locking means, the dispensing member must be urged to the open position. In the preferred embodiment, a portion of the dispensing member extend exteriorly of the sleeve such that pressure may be applied thereto.

In a preferred embodiment, there are provided resilient biasing means which bias the dispensing member to a closed position and which force must be overcome by the pressure exerted in opening the package or device. Many biasing means may be used such as spring members and the like. In a preferred embodiment, an integrated specially ribbed resilient member is formed as a part of the dispensing member.

The device may be formed of various materials although in the preferred embodiment, it is formed of an injection molded plastic, both for ease of manufacture and operation.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
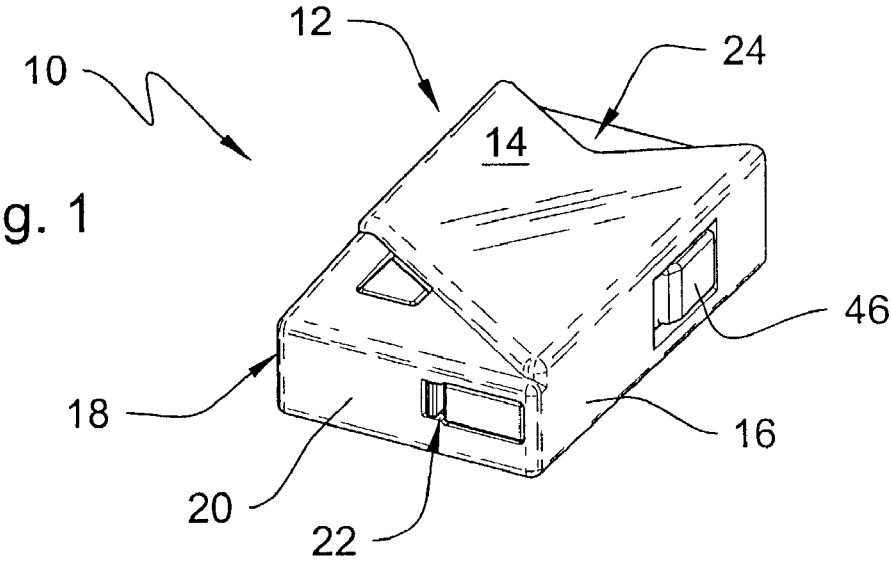
FIG. 1 is a perspective view of the device when in a closed non-dispensing position.

Referring to the drawings in greater detail and by reference characters thereto, there is illustrated a dispensing device which is generally designated by reference numeral 10 and which dispensing device 10 includes a housing generally designated by reference numeral 12.

Housing 12 includes a top wall 14, a first side wall 16, a second side wall 18 and a front wall 20. A bottom wall (not shown) extends between side walls 16 and 18. There is also provided a front wall opening or aperture 22 for reasons which will become apparent hereinbelow. Top wall 14 has, at its rear marginal edge, a V-shaped configuration generally designated by reference numeral 24.

Mounted interiorly of housing 12 is a dispensing member generally designated by reference numeral 26. Dispensing member 26 has a bottom wall 28, a back wall 30 and a partial top wall 32. A first side wall generally designated by reference numeral 34 is comprised of a rear segment 36 and an inset segment 38 which merges to a front segment 40. Extending rearwardly from front segment 40 is a locking tab generally designated by reference numeral 42. Locking tab 42 includes a flexing portion 44 and a locking portion 46. An abutment shoulder 48 is provided on locking portion 46 and which abutment shoulder has a reverse angle to ensure secure locking.

A second side wall generally designated by reference numeral 50 is comprised of a rear segment 52 which merges with an inset segment 54 similar that of first side wall 34. However, from inset segment 54, there is provided an inwardly extending segment 56 which in turn merges with a front segment 58. A front wall 60 extends between front segments 40 and 58.

Extending rearwardly is a second locking tab generally designated by reference numeral 62 and, which is similar to locking tab 42 in that there is provided a flexing portion 64, a locking portion 66 and an abutment shoulder 68.

Extending outwardly from front segment 58 is a locking element 70 having a hook 71. Similarly, a horizontal locking tab 72 extends forwardly from inwardly extending segment 56. Locking tab 72 includes a raised land portion 73 which forms an abutment shoulder 74. Bottom wall 28 is substantially planer except in the area proximate front segments 40 and 58. Thus, there is provided an upwardly extending ramp 76 which leads to a stepped portion 78 having downwardly extending ramp 79. Defined between front segments 40 and 58 and front wall 60 is a dispensing cavity generally designated by reference numeral 80. Rearwardly of stepped portion 78, there is formed a product storage cavity generally designated by reference numeral 82.

Figure 10:
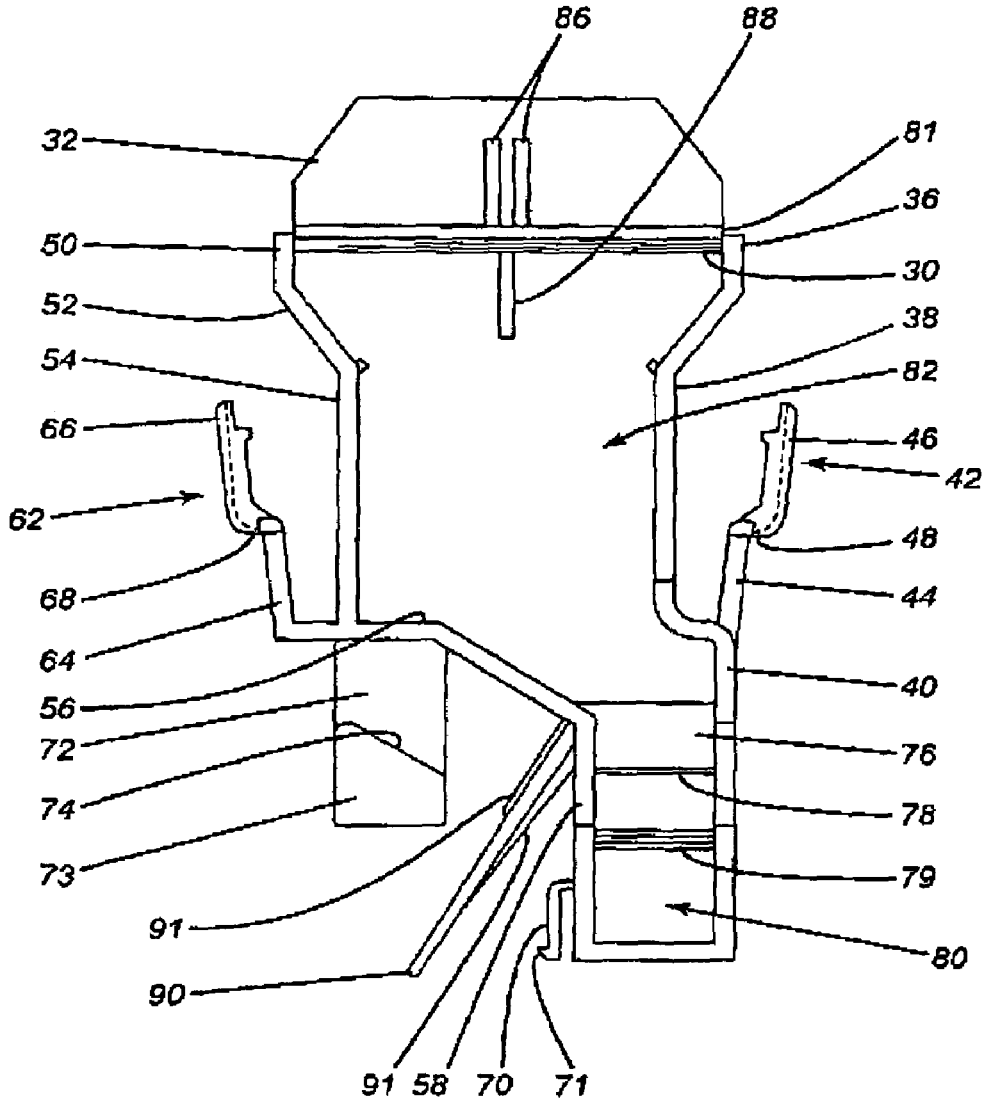
FIG. 10 is a top plan view of the dispensing member following manufacture and before assembly.

In manufacture, and as may be best seen in FIG. 10, the back wall 30 and top wall 32 are formed integrally with bottom wall 28 and are provided with a living hinge. A pair of locking bars 86 on top wall 32 are designed to engage with a locking bar 88 on bottom wall 28.

There is also provided a ribbed spring member 90 which comprises a flexible member extending outwardly at the juncture of inwardly extending segment 56 and front segment 58. Tapered ribs 91 on the front and back of spring member 90 along with the extension of the spring member ensures proper biasing.

Figure 4:
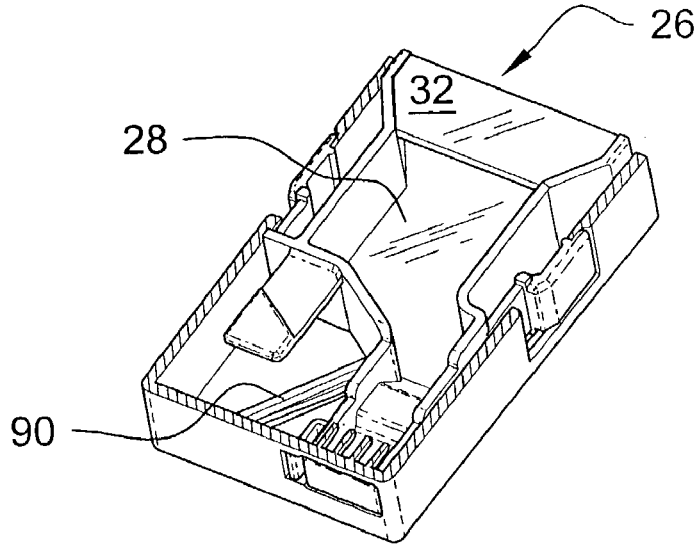
FIG. 4 is a perspective view of the device when in a closed position with the cover of the housing removed for clarity.
Figure 5:
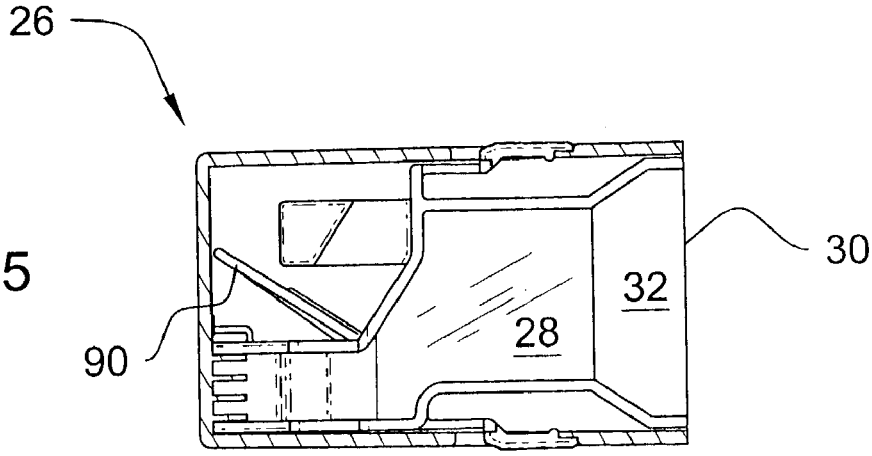
FIG. 5 is a top plan view of the arrangement of FIG. 4.

In operation, after forming back wall 30 and top wall 32, the product to be dispensed may be placed within product storage cavity 82 and the dispensing member 26 placed within housing 12. In the fully closed position, as seen in FIGS. 1, 4 and 5, the rear portion of the dispensing member extends outwardly due to the V-shaped edge 24 of top wall 14. Locking element 70 prevents rearward movement of dispensing member 26. When closed, locking tab 72 has abutment shoulder 74 engaging a portion of top wall 14.

When in a closed position, as shown in FIGS. 1, 4 and 5, dispensing member 26 is located within housing 12 with back wall 30 extending beyond V-shaped notch 24. Dispensing cavity 80 is inaccessible and the dispensing member is prevented from moving rearwardly due to locking element 70 engaging front wall 20.

Figure 2:
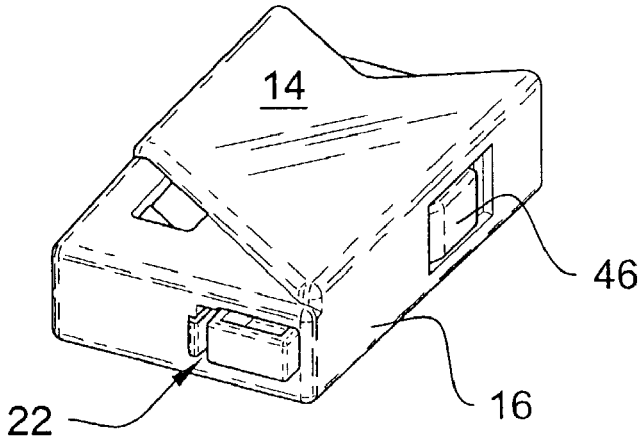
FIG. 2 is a perspective view similar to FIG. 1 when the device is in a partially open intermediate position.
Figure 6:
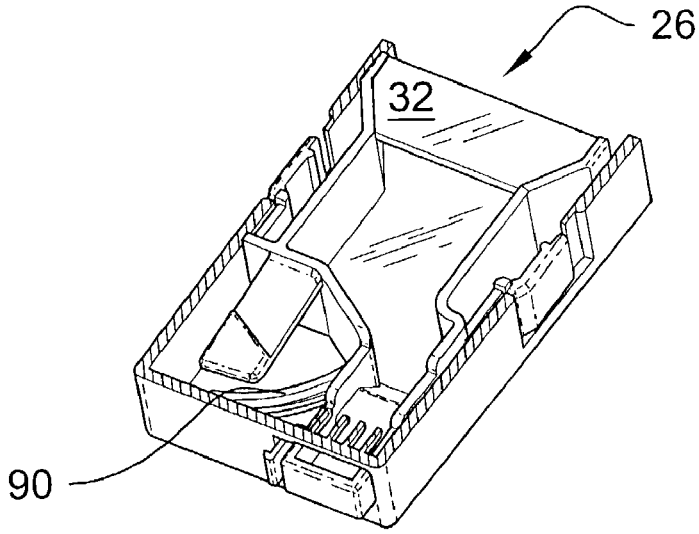
FIG. 6 is a perspective view of the device when the dispensing member is in a partially open position, again with the top of the housing removed.
Figure 7:
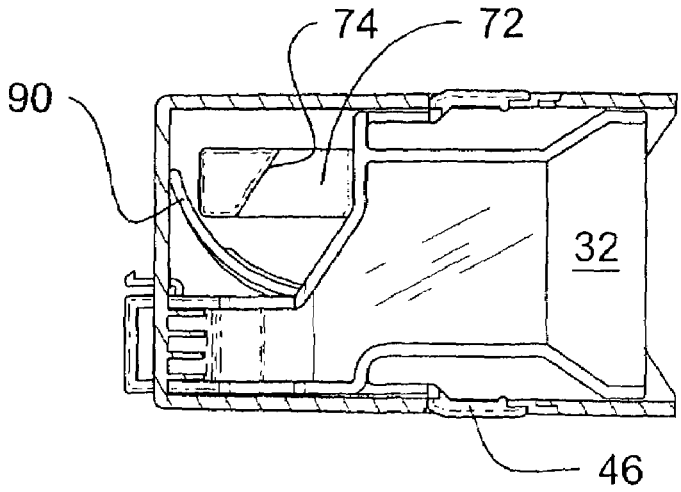
FIG. 7 is a top plan view of the arrangement of FIG. 6.

In a first movement, the dispensing member 26 may be moved to the position illustrated in FIGS. 2, 6 and 7. In order to do so, a first locking means is unlocked and this may be done by depressing raised land portion 73 such that abutment shoulder 74 is disengaged from top wall 14 of housing 12. In so doing, dispensing cavity 80 moves slightly outwardly such that visual access may be had thereto, but a product may not be dispensed. With this movement, abutment shoulders 48 and 74 of locking tabs 42 and 72 respectively will engage the side wall of housing 12.

Figure 3:
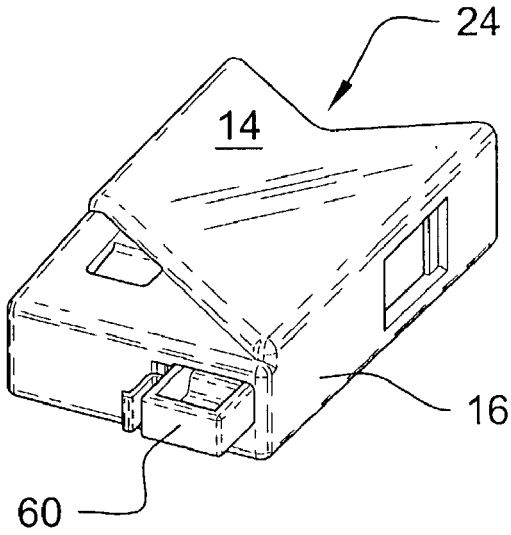
FIG. 3 is a perspective view similar to FIGS. 1 and 2 when the device is in a fully open dispensing position.
Figure 8:
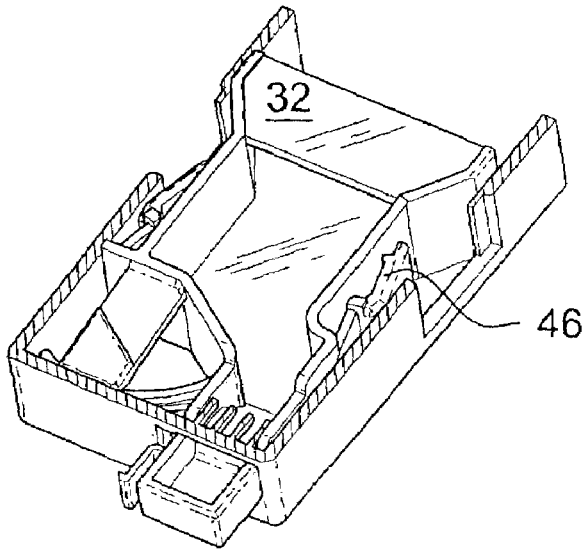
FIG. 8 is a perspective view of the device in a fully open dispensing condition, again with the top wall of the housing portion being removed for purposes of clarity.
Figure 9:
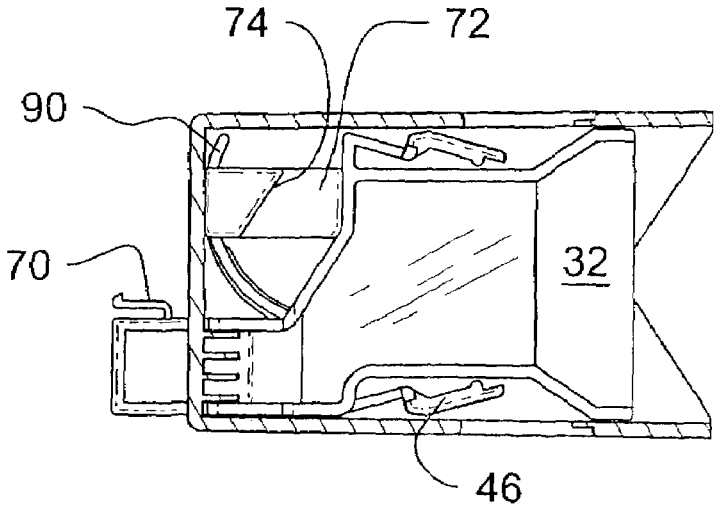
FIG. 9 is a top plan view of the arrangement of FIG. 8.

In order to fully open and to have access to dispensing cavity 80, both of locking tabs 42 and 72 must be pushed inwardly as shown in FIGS. 3, 8 and 9. Then, access may be had to the product contained therein.

The movement of dispensing member 26 is achieved by pressing on back wall 30 of dispensing member 26 while pressing on front wall 20 as in a squeezing motion using the thumb and second finger. At the same time, and as may be seen in FIGS. 6 through 9, spring member 90 abuts against front wall 20 of housing 12 to exert a biasing force rearwardly. Thus, pressure must be maintained on back wall 30 and on front wall 20 in order to provide access to the dispensing cavity 80.

In use, the product may be placed within product storage cavity 82. Prior to opening the container, the dispensing device would be tilted downwardly such that the product would enter through the channel formed between product storage cavity 82 and dispensing cavity 80. As previously mentioned, a channel is sized to permit the passage of only a single product. Also, a dessicant could be placed within the compartment below locking tab 72, if required.

It will be understood that the above described embodiment is for purposes of illustration only and that changes and modifications may be made thereto without departing from the spirit and scope of the invention.

I claim:

1. A device for dispensing a controlled quantity of product comprising:

a housing;

a dispensing member having a dispensing cavity formed therein, said dispensing member being movable from a first position wherein said dispensing cavity is rendered inaccessible within said housing and a second position wherein said dispensing cavity is exterior of said housing to permit dispensing a product therefrom; and first and second cooperative locking means on both of said dispensing member and said housing, both of said first and second locking means being operative such that when said dispensing member is in said first position with said dispensing cavity within said housing, said first locking means function to maintain the dispensing member and housing in a locked relationship, said second locking means permitting limited movement between the dispensing member and housing while maintaining a locking relationship such that when said first locking means are moved from a locked to an unlocked position, said second locking means remain locked.

2. The device of claim 1 wherein said housing is in the form of a sleeve and said movable member has first and second opposed ends, said first end extending exteriorly of said sleeve when in said first position, said second end having said dispensing cavity located therein, the arrangement being such that finger pressure may be applied to said first end to move said dispensing member to said second position where said dispensing cavity is exterior of said housing.

3. The device of claim 2 wherein said dispensing cavity is sized to receive a single unit of said product therein.

4. The device of claim 2 wherein said dispensing member has a product storage cavity located proximate said first end, a channel extending between said product storage cavity and said dispensing cavity, said channel being sized to permit the passage of a single unit of said product.

5. The device of claim 2 wherein said housing and said dispensing member are formed of an injection molded plastic.

6. The device of claim 1 further including biasing means biasing said dispensing member towards said first position.

7. The device of claim 1 wherein said housing has a top wall, a bottom wall and a pair of side walls, said dispensing member having a dispensing member bottom wall, a dispensing member top wall, and dispensing member side walls, said dispensing member bottom wall lying in juxtaposition to said housing bottom wall, and said side walls of said dispensing member lying in juxtaposition to respective side walls of said housing.

8. The device of claim 7 wherein said first cooperative locking means is formed in said housing top wall and said dispensing member top wall.

9. The device of claim 8 wherein said second cooperative locking means are formed in at least one of said side walls of said housing and dispensing member.

10. The device of claim 9 wherein said second cooperative locking means are formed in each of said side walls of said housing and dispensing member.

11. The device of claim 7 wherein said first locking means comprises a resilient tab member adapted to engage an abutment surface formed in said top wall of said housing.

* * * * *